United States Patent [19]

Pettit et al.

[11] Patent Number: 4,930,820

[45] Date of Patent: Jun. 5, 1990

[54] CAM HANDLE LOCK

[75] Inventors: Dean A. Pettit; Gregory J. Vetter, both of Owatonna, Minn.

[73] Assignee: Truth Incorporated, Owatonna, Minn.

[21] Appl. No.: 421,797

[22] Filed: Oct. 16, 1989

[51] Int. Cl.[5] ..... E05C 3/04

[52] U.S. Cl. ..... 292/204; 292/197; 292/200

[58] Field of Search ..... 70/204, 103, 147, 178, 70/275, 349, 350, 353, 202, 197, 200

[56] References Cited

U.S. PATENT DOCUMENTS 2,973,985 3/1961 Siegal ..... 292/204

4,801,164 1/1989 Mosch ..... 292/204

FOREIGN PATENT DOCUMENTS 186191 11/1963 Sweden ..... 292/350

*Primary Examiner*—Robert L. Wolfe

*Attorney, Agent, or Firm*—Wood, Phillips, Mason, Recktenwald & Vansanten

[57] ABSTRACT

A cam handle lock having a cam handle rotatably associated with an mounting base. The base has a central opening to receive a stem of the cam handle. A thin metal washer is fixed to an end of the stem and structurally arranged to coact with the base whereby the washer is flexed to spring load the cam handle and base into firm engagement with each other.

10 Claims, 1 Drawing Sheet

CAM HANDLE LOCK

DESCRIPTION

1. Field of the Invention

This invention pertains to a cam handle lock and, more particularly, to a cam handle lock having improved strength and reliability. A cam handle is rotatably associated with a base. The cam handle and base are spring loaded into contact with each other by means of a flexed washer secured to the cam handle by a screw.

2. Background of the Invention

Cam handle locks are usable for locking a window sash in closed position and have a cam handle rotatably mounted on a base. The base is attachable to a window sash and the window frame mounts a strike housing. A locking member on the cam handle engages with a strike insert in the strike housing in one rotative position of the cam handle for locking of the window sash. A 90 degree rotation of the cam handle frees the strike housing from engagement with the cam handle and permits opening of the window sash.

A commercially-available cam handle lock manufactured by applicants' assignee has a base with a central opening which rotatably receives a stem of the cam handle. A free end of the stem is spun to form an enlargement which captures a washer. A Belleville spring is captured between the washer and base to urge a surface on the cam handle into contact with a raised surface on a front side of the base. After a certain amount of use and rotation of the cam handle, the cam handle becomes loose and there is a resulting lack of firmness when the cam handle is rotated between locked and unlocked positions.

SUMMARY OF THE INVENTION

A primary feature of the invention is to provide a cam handle lock having an improved structure for rotatably associating the cam handle with a base whereby the cam handle lock has increased strength and reliability and there is a firm feel in operating the cam handle lock even after a considerable amount of use.

Another feature of the invention is to provide a cam handle lock having a less complex structure than cam handle locks previously known and which maintains the components in firm engagement. These results are achieved by use of a washer rotatably fixed to the cam handle and which is flexed by coaction with a shaped recess in the base for the cam handle lock to provide spring-loading which urges the cam handle into firm engagement with the base, while permitting rotation of the cam handle relative to the base. The washer is fixed to the cam handle by an epoxy bonded screw.

An object of the invention is to provide a cam handle lock having a base, a cam handle pivotally mounted on said base and a separate strike member for selective engagement by said cam handle, the improvement comprising, a shaped recess in said base, a washer in said shaped recess making a circular contact therewith inwardly of the periphery of said washer, and a threaded member capturing said washer and threaded into said cam handle to concavely deform said washer and cause said washer to function as a spring holding said cam handle tightly to said base.

Still another object of the invention to provide a cam handle lock having a base with a central opening, a cam handle pivotally mounted on said base by a stem rotatable in said central opening, a shaped recess in said base including a raised annular surface, a washer in said shaped recess making a circular contact with the raised annular surface inwardly of the periphery of said washer. The washer is captured by means which concavely deforms the washer against said raised annular surface and causes the washer to function as a spring holding said cam handle tightly to said base.

A further object of the invention is to provide a cam handle lock comprising, a base having a raised surface on a front side and a recess on a back side, the shaped recess being defined by a peripheral wall and having a central opening, said recess having a base surface surrounding said central opening and a substantially annular surface inwardly of the peripheral wall and at a level above the base surface, a cam handle having a surface in contact with said raised surface of the base and a stem rotatable in said central opening of the base, said stem having an inner end, a relatively thin washer in said recess abutting said end of said stem and having an area adjacent the outer periphery thereof overlying said substantially annular surface, with said washer being flexed into a shape to spring load the cam handle surface against the raised surface of the base.

DESCRIPTION OF THE PREFERRED EMBODIMENT

Figure 1:
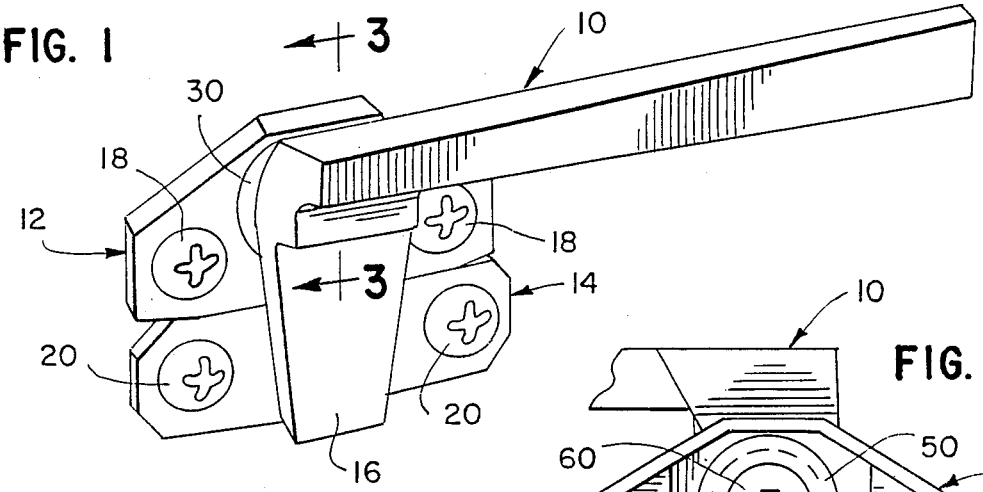
FIG. 1 is a perspective view of the cam handle lock, showing the cam handle in locked position.

The cam handle lock is shown generally in FIG. 1 with the primary components being a cam handle, indicated generally at 10, a base, indicated generally at 12, and a strike member, indicated generally at 14. The cam handle 10 is rotatably mounted on the base 12 for movement between the locked position, shown in FIG. 1, and an unlocked position wherein the cam handle is rotated counterclockwise 90 degrees from the position shown. The cam handle has a leg 16 forming a locking member with a cam surface **16*a* for coaction with the strike member 14**. The strike member can have a raised strike insert (not shown) which is engaged by the locking member when the cam handle is in locked position.

Each of the base 12 and strike member 14 have a pair of spaced-apart openings for mounting thereof and, as seen in FIG. 1 threaded members 18 can extend through the openings in the base 12 for mounting the cam handle and base to a window sash.

A pair of threaded members 20 extend through the openings in the strike member for mounting the strike member to the window frame.

Figure 2:
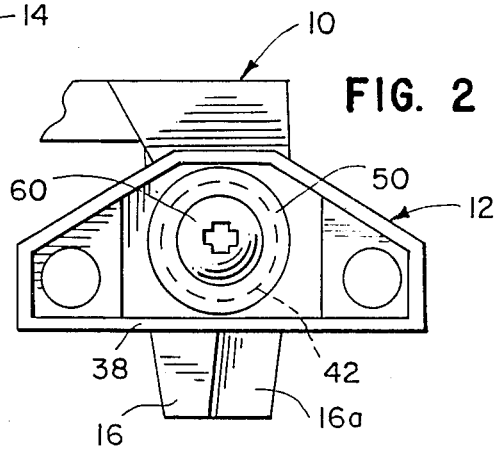
FIG. 2 is a fragmentary elevational view of the reverse side of the cam handle lock, with the strike housing omitted.
Figure 3:
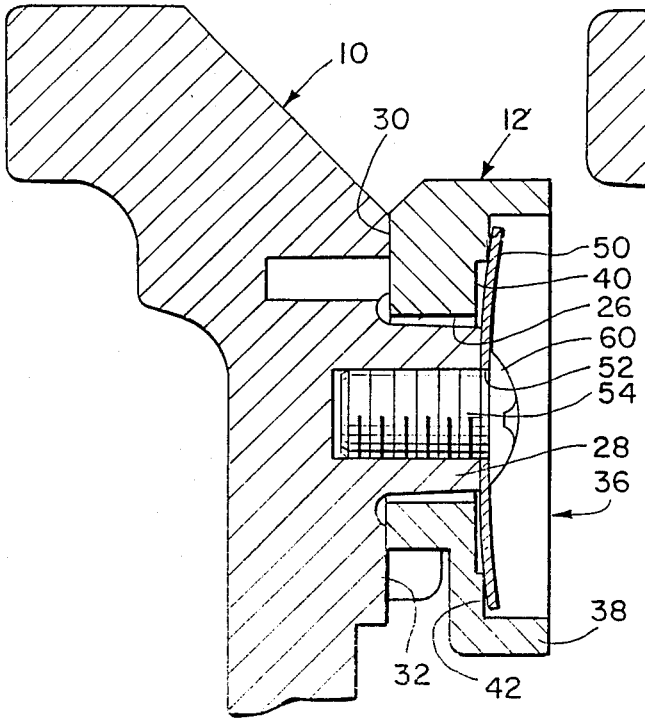
FIG. 3 is a vertical section, on an enlarged scale taken generally along the line 2—2 in FIG. 1, with the strike housing omitted.

The structure of the base 12 is best seen in FIGS. 2 and 3. The base 12 has a central opening 26 which receives a stem 28 of the cam handle 10. The base 12 has a raised surface 30 which coacts with a surface 32 on the cam handle 10. Structure to be described spring loads these surfaces against each other to provide a firm feel in operation of the cam handle between locked and unlocked positions. These positions are established by an abutment on the cam handle which moves between limit abutments on the raised surface 30 (not shown).

The base 12 has a shaped recess, indicated generally at 36 on the back side thereof, which is defined by a peripheral wall 38. The shaped recess has a base surface 40 radially surrounding the central opening 26 in the base. A raised annular surface in the form of an annular ledge 42 is at a level above the base surface 40 and is inwardly adjacent the peripheral wall 38.

A full hard relatively thin metal washer 50 is positioned within the shaped recess 36 and has a diameter to have an area adjacent the outer periphery thereof overlying the annular ledge 42. The washer has a central opening 52 to receive a threaded member, screw 54, which threads into the stem 28 of the cam handle. The free end of the cam handle stem extends into the shaped recess a distance slightly beyond the base surface of the shaped recess, but short of the level of the annular ledge 42. Capture of the washer by a head 60 of the screw 54 and torquing of the screw into the stem of the cam handle causes flexing of the washer 50, as seen in FIG. 3, whereby the washer functions as a spring to spring load the cam handle surface 32 into firm engagement with the raised surface 30 of the base 12. Although not visible in the drawings, during assembly of the cam handle lock, a lubricant is applied to lubricate the engagement between the outer peripheral area of the washer and the annular ledge 42 of the base. The screw 54 is bonded to the central stem 28 by a suitable material, such as an epoxy resin.

Figure 4:
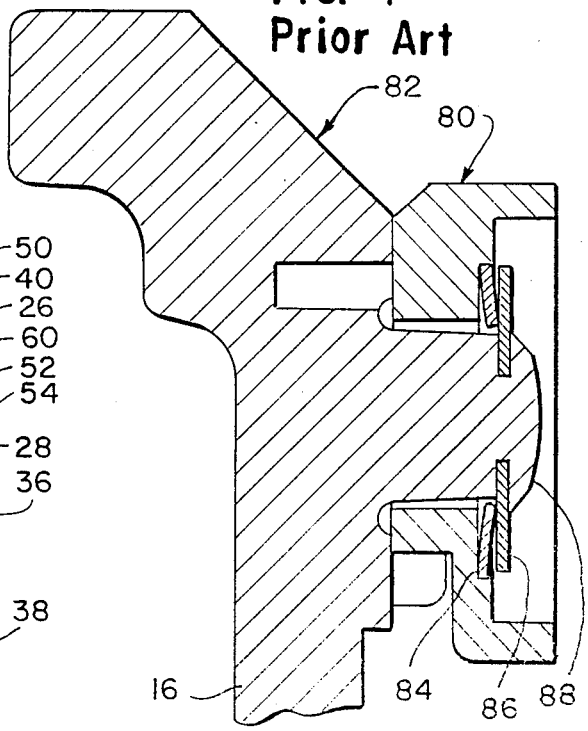
FIG. 4 Prior Art
FIG. 4 is a view, similar to FIG. 3, of the previously-referred to prior art structure.

The prior art structure previously described is illustrated in FIG. 4 wherein a base 80 rotatably mounts a cam handle 82 and these parts are held in rotative engagement by a Belleville spring 84 which is captured on a cylindrical end of the cam handle stem by means of a washer 86 which is locked in position by an enlarged end 88 of the stem formed by a spinning process.

We claim:

1. A cam handle lock having a base, a cam handle pivotally mounted on said base and a separate strike member for selective engagement by said cam handle, the improvement comprising, a shaped recess in said base, a thin metal washer in said shaped recess making a circular contact therewith inwardly of the periphery of said washer, and a threaded member capturing said washer and threaded into said cam handle to concavely deform said thin metal washer and cause said washer to function as a spring holding said cam handle tightly to said base.

2. A cam handle lock as defined in claim 1 wherein said base has a peripheral wall defining said shaped recess, a central opening in said base communicating with said shaped recess, an annular ledge in said shaped recess between said peripheral wall and said central opening making said circular contact with said washer.

3. A cam handle lock as defined in claim 2 including a lubricant between said washer and said annular ledge.

4. A cam handle lock as defined in claim 2 wherein said cam handle has a stem rotatable in said central opening of the base and said threaded member being a screw extended through the washer and threaded into said cam handle stem.

5. A cam handle lock comprising, a base having a raised surface on a front side and a shaped recess on a back side defined by a peripheral wall, a central opening in said base, said shaped recess having a base surface surrounding said central opening and an annular ledge inwardly adjacent the peripheral wall and at a level above the base surface, a cam handle having a surface in contact with said raised surface of the base and a stem rotatable in said central opening of the base, said stem having an inner end which extends into the recess beyond the base surface of the recess but short of the annular ledge, a relatively thin washer in said shaped recess having an area adjacent the outer periphery thereof overlying said ledge, a screw extended through an opening in the washer and threaded into said stem to flex the washer into a shape to spring load the cam handle surface against the raised surface of the base.

6. A cam handle lock as defined in claim 5 including a lubricant between the washer and the annular ledge to facilitate relative movement therebetween as the washer rotates with the cam handle.

7. A cam handle lock as defined in claim 5 wherein said washer is made of full hard metal.

8. A cam handle lock having a base with a central opening, a cam handle pivotally mounted on said base by a stem rotatable in said central opening, a shaped recess in said base including a raised annular surface, a washer in said shaped recess making a circular contact with the raised annular surface inwardly of the periphery of said washer, and a threaded member capturing said washer and threaded into said stem to concavely deform said washer against said raised annular surface and cause said washer to function as a spring holding said cam handle tightly to said base.

9. A cam handle lock as defined in claim 8 wherein said base has a peripheral wall defining said shaped recess and said raised annular surface is an annular ledge between said peripheral wall and said central opening.

10. A cam handle lock comprising, a base having a raised surface on a front side and a recess on a back side, the shaped recess being defined by a peripheral wall and having a central opening, said recess having a base surface surrounding said central opening and a substantially annular surface inwardly of the peripheral wall and at a level above the base surface, a cam handle having a surface in contact with said raised surface of the base and a stem rotatable in said central opening of the base, said stem having an inner end, a relatively thin washer in said recess abutting said end of said stem and having an area adjacent the outer periphery thereof overlying said substantially annular surface, with said washer being flexed into a shape to spring load the cam handle surface against the raised surface of the base.

* * * * *